US008758101B2

(12) United States Patent
Khalitov et al.

(10) Patent No.: US 8,758,101 B2
(45) Date of Patent: Jun. 24, 2014

(54) TUBULAR INLINE EXHAUST FAN ASSEMBLY

(75) Inventors: Daniel Khalitov, St. Louis Park, MN (US); Andrew W. McClure, Ramsey, MN (US)

(73) Assignee: Twin City Fan Companies, Ltd., Minneapolis, MN (US)

( * ) Notice: Subject to any disclaimer, the term of this patent is extended or adjusted under 35 U.S.C. 154(b) by 25 days.

(21) Appl. No.: 13/517,319

(22) PCT Filed: Sep. 6, 2011

(86) PCT No.: PCT/US2011/050527

§ 371 (c)(1),
(2), (4) Date: Jun. 20, 2012

(87) PCT Pub. No.: WO2012/031295

PCT Pub. Date: Mar. 8, 2012

(65) Prior Publication Data

US 2013/0011239 A1 Jan. 10, 2013

Related U.S. Application Data

(60) Provisional application No. 61/379,832, filed on Sep. 3, 2010.

(51) Int. Cl.
*F04D 29/40* (2006.01)
*F04D 29/54* (2006.01)

(52) U.S. Cl.
USPC ..... 454/339; 454/367; 415/119; 415/182.1; 415/220; 415/219.1; 415/218.1; 181/198; 181/205; 181/206; 181/210; 181/224

(58) Field of Classification Search
CPC ... F04D 29/544; F04D 29/5806; F04D 29/66; F04D 29/664; B08B 15/007; F04B 2027/16; F04B 2027/1886; F04B 25/04; F04B 27/005
USPC ..... 454/344, 345, 353, 49
See application file for complete search history.

(56) References Cited

U.S. PATENT DOCUMENTS 2,544,379 A * 3/1951 Davenport ..... 454/344
3,090,545 A * 5/1963 Bristol ..... 417/360

(Continued)

OTHER PUBLICATIONS

Copenheaver, Blaine R., PCT International Search Report and Written Opinion of the International Searching Authority, PCT Application No. PCT/US11/50527, Jan. 31, 2012.

(Continued)

*Primary Examiner* — Kang Hu
*Assistant Examiner* — Martha Becton
(74) *Attorney, Agent, or Firm* — Nawrocki, Rooney & Silverton, P.A.

(57) ABSTRACT

An improved exhaust fan housing, and exhaust fan assembly so characterized, is generally provided. The exhaust fan housing includes a first cylindrical or conical element, a second cylindrical element interior of the first cylindrical element, and a plurality of hollow vanes traversing an annular fluid passage chamber delimited thereby and uniting the first and second cylindrical elements. A central drive chamber, delimited by the second cylindrical element, is in fluid communication with ambient air exterior of the first cylindrical element via the hollow vanes. Each hollow vane is characterized by spaced apart wall segments which unitingly terminate so as to delimit a leading edge for each hollow vane, each of the spaced apart wall segments having a free end or a closed end delimiting first and second trailing edges for the hollow vanes.

35 Claims, 12 Drawing Sheets

(56) References Cited

U.S. PATENT DOCUMENTS

| | | | | |
|---|---|---|---|---|
| 3,199,774 | A | 8/1965 | Lowell | |
| 3,312,386 | A * | 4/1967 | Hull et al. | 415/218.1 |
| 3,412,928 | A * | 11/1968 | Hull et al. | 415/214.1 |
| 3,556,246 | A * | 1/1971 | Hilbig | 181/215 |
| 4,344,370 | A | 8/1982 | Smith et al. | |
| 4,806,076 | A * | 2/1989 | Andrews | 415/220 |
| 6,112,850 | A * | 9/2000 | Secrest et al. | 181/224 |
| 6,431,974 | B1 * | 8/2002 | Tetley et al. | 454/33 |
| 7,077,739 | B2 * | 7/2006 | Kupferberg et al. | 454/1 |
| 7,320,636 | B2 * | 1/2008 | Seliger et al. | 454/63 |
| 2005/0159101 | A1 * | 7/2005 | Hrdina et al. | 454/356 |
| 2005/0159102 | A1 * | 7/2005 | Seliger et al. | 454/356 |
| 2005/0166809 | A1 * | 8/2005 | Sixsmith | 110/160 |
| 2007/0298700 | A1 * | 12/2007 | Datta | 454/1 |
| 2008/0200108 | A1 * | 8/2008 | Kupferberg | 454/40 |
| 2010/0285730 | A1 * | 11/2010 | Kupferberg | 454/44 |

OTHER PUBLICATIONS

NASA, Glenn Research Center, "Wing Geometry Definitions," URL: http://wright.nasa.gov/airplane/geom.html; 2010.

* cited by examiner

10 GA MAT'L

10 GA MAT'L

SECTION A-A

TUBULAR INLINE EXHAUST FAN ASSEMBLY

This is an international patent application filed pursuant to 35 USC §363 claiming priority under 35 USC §120 of/to U.S. Patent Application Ser. No. 61/379,832 having a filing date of Sep. 3, 2010 and entitled TUBULAR INLINE FAN ASSEMBLY/HOUSING WITH HOLLOW VANES, the disclosure of which is hereby incorporated by reference in its entirety.

TECHNICAL FIELD

The present invention generally relates to a fan housing characterized by hollow vanes, more particularly, to an exhaust fan assembly, such as a direct drive tubular inline exhaust fan assembly, characterized by such fan housing.

BACKGROUND OF THE INVENTION

The transport of deleterious/potentially deleterious gases and/or the transport/removal of same from spaces so characterized is an important, oftentimes critical operation. For example, and without limitation, the venting of high-temperature, particular laden, toxic, noxious, corrosive, etc. "gases" or fumes from work places such as laboratories, industrial or chemical processing areas or other environments such as tunnels are well known. Heretofore, and generally, such fumes have been either guided to a tall exhaust stack whereby they are discharged at a height well above ground/roof level, or, during the process of evacuating such fumes, make-up or "fresh" air is introduced so as to mix and thereby dilute the contaminated air, with a high velocity roof top discharge of the diluted air commonplace.

In the context of direct drive tubular inline fan housings/assemblies, traditionally they have been characterized by a so called "bifurcated" design which is intended to isolate, and to some degree cool a fan motor from the contaminated air stream, as well as single-thickness vanes to support the fan motor and "straighten" the air stream "swirl" downstream of the fan impeller, see e.g., U.S. Pat. No. 7,320,363 B2 (Seliger et al.), incorporated herein by reference in its entirety. Moreover, in the context of induced flow fans characteristic of chemical, industrial, manufacturing fume exhaust operations, such direct drive tubular inline fan housings/assemblies are characterized by contraction nozzles for high-speed discharge, and windbands for dilution of fume efflux with ambient air, see e.g., Seliger et al.

Further still, in the context of induced flow fan assemblies, fume exhaust accessories include, and may not be limited to, multiple nozzles of differing outlet areas to accommodate/achieve operating points/velocities believed advantageous, an isolation damper to prevent flow reversal through an idle fan in a parallel fan configuration of a plenum assembly, a bypass damper to maintain nozzle outlet velocity by drawing upon additional ambient air when efflux flow is reduced in a variable exhaust system, and/or a weather management system to prevent precipitation ingress to the system, structures thereof and the structure within which the assembly is deployed.

In as much as apparent improvements have been made with regard to service/maintenance of components of such systems and marginal efficiencies with regard to operating efficiencies and sound attenuation for such systems, it is nonetheless believed that heretofore known functionality may be achieved with a simplified structure/assembly, e.g., a fan housing, which circumvents, eliminates or at least reduces what is believed to be unnecessary momentum and energy losses attendant to any of the functions of "swirl" straightening, motor cooling/protection, high-speed upblast discharge, and/or fume efflux dilution, especially at high airflow rates, while at least maintaining present industry efficiencies as to operation and/or sound output. Moreover, in relation to induced flow fan accessories (i.e., the functional objectives thereof), it is believed that such function can be retained while nonetheless eliminating heretofore known structures owing to, among other things, synergistic effects having origins in Applicant's simplified structure/assembly.

SUMMARY OF THE INVENTION

An improved exhaust fan housing, and exhaust fan assembly so characterized, is generally provided. The exhaust fan housing includes a first cylindrical element, a second cylindrical element interior of the first cylindrical element, and a plurality of hollow vanes traversing an annular fluid passage chamber delimited thereby and uniting the first and second cylindrical elements. A central drive chamber, delimited by the second cylindrical element, is in fluid communication with ambient air exterior of the first cylindrical element via the hollow vanes. Each hollow vane is characterized by spaced apart wall segments which unitingly terminate so as to delimit a leading edge for each hollow vane, each of the spaced apart wall segments having a free end or a closed end delimiting first and second trailing edges for the hollow vanes.

DETAILED DESCRIPTION OF THE INVENTION

Figure 1:
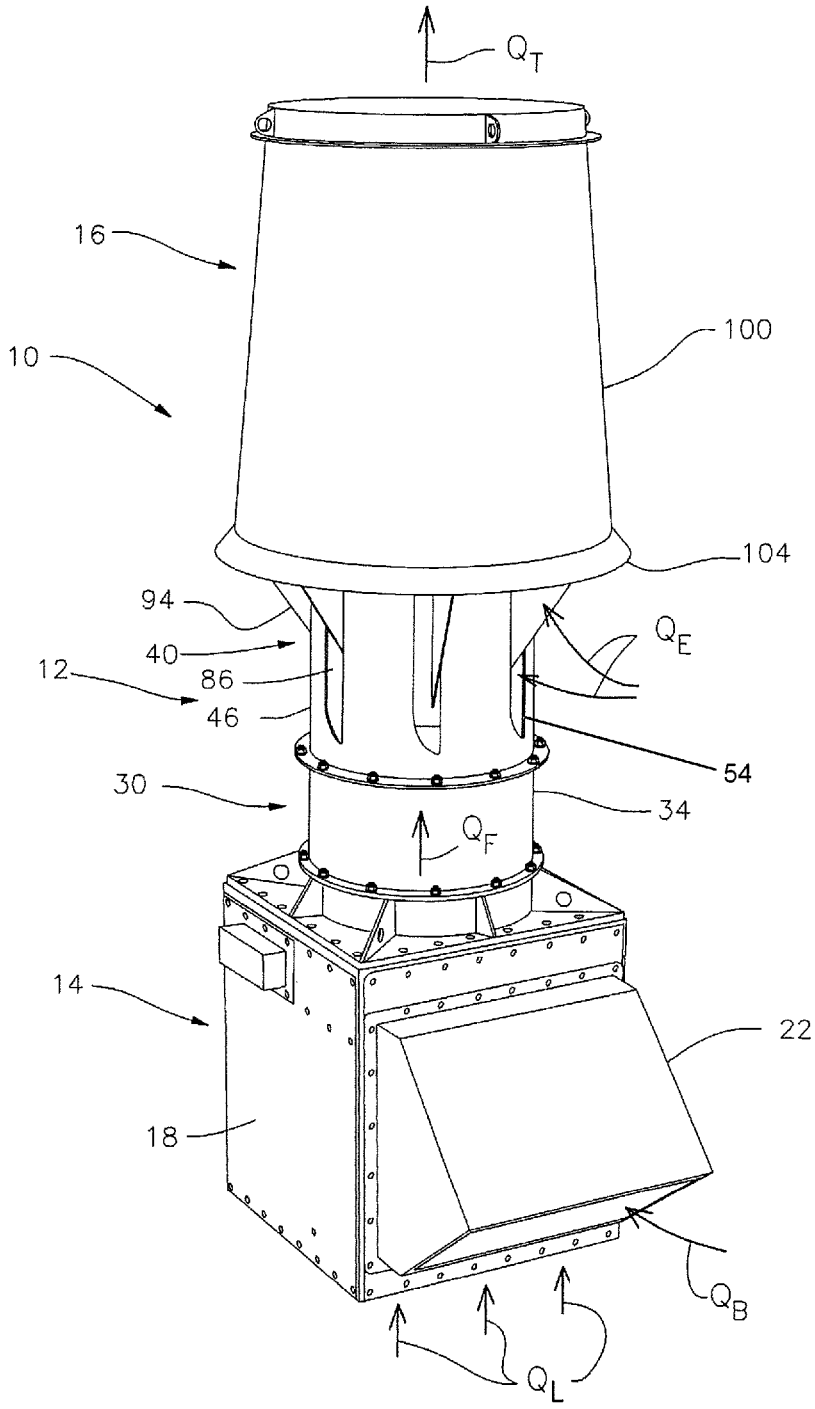
FIG. 1 depicts a single direct drive mixed flow induced flow exhaust assembly.
Figure 3:
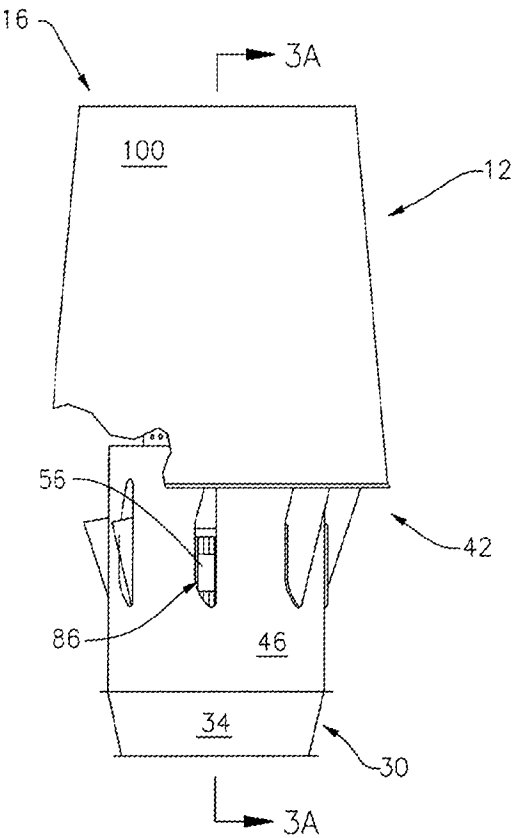
FIG. 3 depicts, in elevation, a representative, non-limiting sound attenuated fan assembly having particular utility in relation to, for example, a single direct drive mixed flow induced flow exhaust assembly.
Figure 4A:
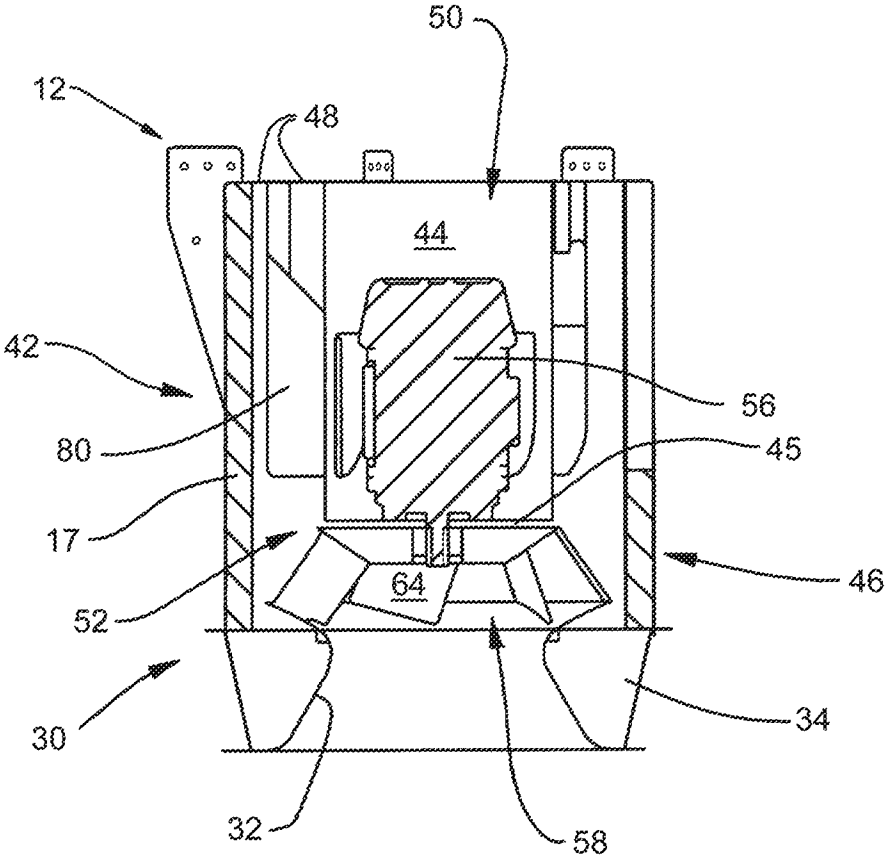
FIG. 4A is a section, about line A-A, of the fan housing of FIG. 4.
Figure 4:
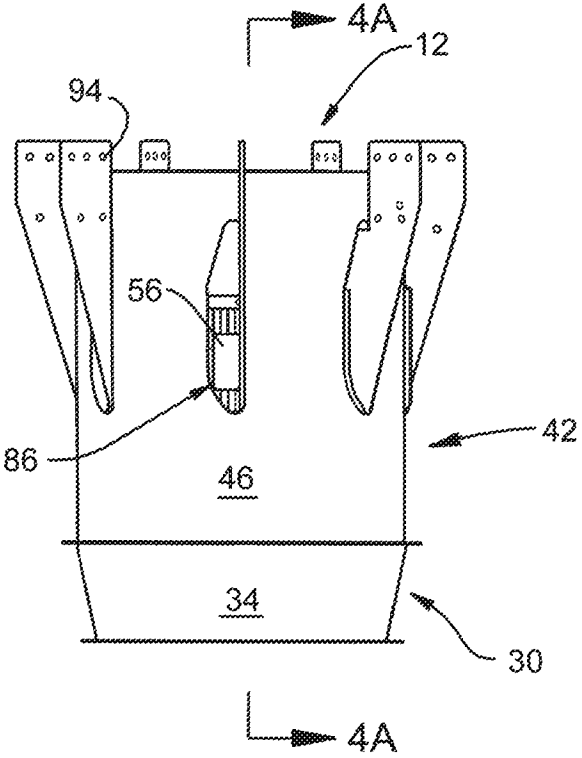
FIG. 4 depicts, in elevation, the fan housing of the sound attenuated fan assembly of FIG. 3.
Figure 6:
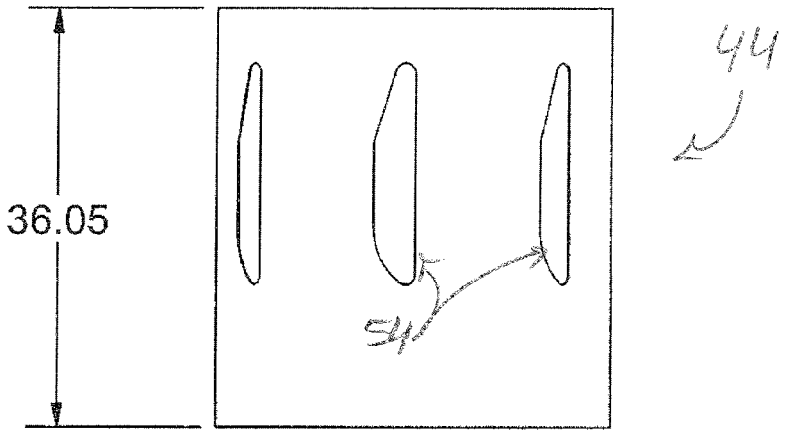
FIG. 6 depicts, in elevation, a first representative, non-limiting fan housing shell.
Figure 7:
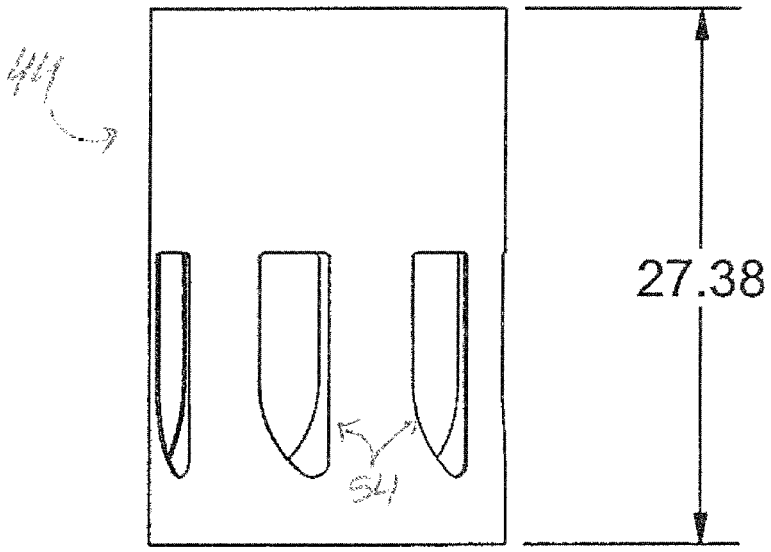
FIG. 7 depicts, in elevation, a further representative, non-limiting motor housing shell.

With regard to the instant description, and the referenced figures, a representative exhaust assembly is generally shown in FIG. 1, exploded view FIG. 2, with select structures, adapted or otherwise, thereof subsequently depicted. For instance, a representative, non-limiting sound attenuated fan assembly having particular utility in relation to, for example, a single direct drive mixed flow induced flow exhaust assembly is shown in FIG. 3; a fan housing of the sound attenuated fan assembly of FIG. 3 is shown in FIG. 4; a representative, non-limiting hollow vane of the fan housing of FIG. 4 is shown in FIG. 5; representative, non-limiting alternate motor housing shell configurations are shown in FIGS. 6 & 7; and, windband/windband assembly particulars are provided for in FIG. 8.

In advance of further particulars, several generalities are to be noted. As is widely known and appreciated, in as much as ventilation systems are commonly associated with buildings, other occupied structures such as tunnels and the like are commonly vented, selectively or otherwise. While the subject description proceeds in the context of building ventilation, the disclosed assemblies, subassemblies and/or elements thereof, alone or in combination with other known or later developed structures are likewise contemplated for application or adaptation in furtherance of accomplishing a general functional objective of more efficiently transporting and/or exhausting deleterious fluids from one or more generally defined spaces.

Figure 2:
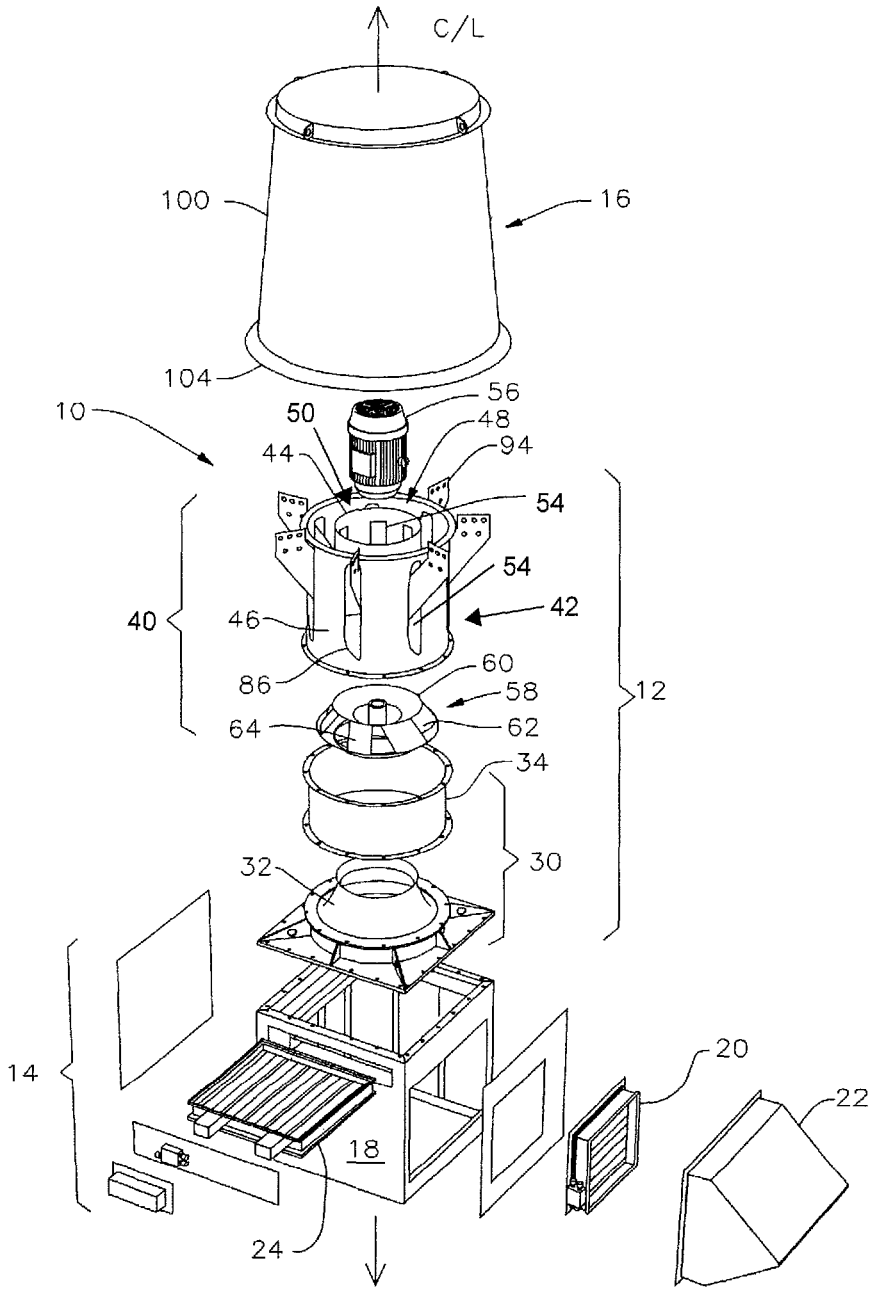
FIG. 2 depicts the exhaust assembly of FIG. 1 in exploded view to reveal structural particulars and relationships for and/or between revealed structures.

With general reference to FIGS. 1 & 2, exhaust assembly 10 may be fairly characterized by a fan assembly 12, a plenum or mixing box 14, and a windband assembly 16. Provisions for multiples of the depicted exhaust assembly, via common place adaptations, are well known and widely practiced.

A variety of fluid flow paths associated with the exhaust assembly of FIG. 1 are generally indicated, more particularly, vented space effluent flow ($Q_L$), by-pass flow ($Q_B$), fan flow ($Q_F$), entrained flow ($Q_E$), and total flow ($Q_T$). Notionally, $Q_F$ is characterized by suction and pressure flow components, and $Q_B$ is fairly characterized by first and second components or contributions, namely, a first by-pass contribution from the ambient into a fan housing of the fan assembly, and a second by-pass contribution from the ambient into the windband via an annular gap delimited by the fan housing and the windband (i.e., the lower periphery thereof as shown). In light of the foregoing, and as is generally understood, several relationships are to be noted, namely:

$$Q_T=Q_E+Q_F;\ Q_F=Q_B+Q_L;\ \therefore Q_T=Q_E+Q_B+Q_L$$

Moreover, both dilution and entrainment ratios, $D_r$ and $D_e$, may be defined as follows:

$$D_r=Q_T/Q_L;\ D_e=Q_T/Q_F$$

Figure 3A:
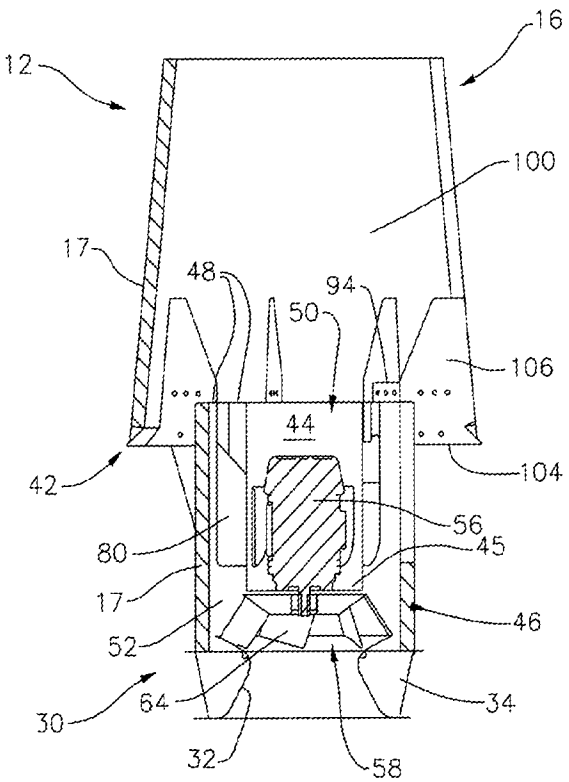
FIG. 3A is a section, about line A-A, of the sound attenuated fan assembly of FIG. 3.

In connection to the elements of the exhaust assembly of FIG. 1, particulars, at least with regard to the plenum and fan assembly, are generally depicted in the exhaust assembly view of FIG. 2. The plenum 14, disposed at the base of the exhaust assembly 10, generally receives vented space effluent flow ($Q_L$) and mixes it with fresh/ambient air, i.e., by-pass flow ($Q_B$), as previously noted. Characteristic of such plenums are the mixing box per se 18, a by-pass damper 20 and related weather hood 22, and an isolation damper 24. Particulars of such plenum or mixers are widely known, with details provided by, among others, Seliger et al. '636, see e.g., FIGS. 3A-4, and the associated written description related thereto.

A fan assembly 12 is in fluid communication with the plenum 14 and may be fairly characterized by first 30 and second 40 fan assembly portions which are in axial alignment in relation to an axial centerline of the exhaust assembly 10 as depicted. The first fan assembly portion 30 generally includes a fan inlet cone 32 in combination with an inlet cone housing 34. The second fan assembly portion 40 generally includes a fan housing 42 characterized by spaced apart inner 44 and outer 46 walls, which alone or in combination delimit: i) an annular fluid passage chamber 48 between the inner wall 44 and the outer 46 wall; ii) a central drive chamber 50 circumferentially bounded by the inner wall 44 and adapted to retain a motor for an exhaust fan; and, iii) an exhaust fan chamber 52 (FIG. 3B) within the outer wall 46 and below the inner wall 44. The second fan assembly portion 40 further includes a plurality of hollow vanes, e.g., airfoil-shaped hollow vanes 80 (FIG. 3A) as depicted, extending between the inner wall 44 and the outer 46 wall of the fan housing 42 of the second fan assembly portion 40 so as to reside within the annular fluid passage chamber 48 thereof.

As will be subsequently and further detailed, the fan housing 42 advantageously includes cylindrical or conical, concentric inner 44 and outer 46 walls, cylindrical as depicted, each characterized by apertures or through holes 54 which are in paired alignment/registration to delimit passageways, a motor 56 within cylindrical or conical inner wall 44 (i.e., within central drive chamber 50), a fan wheel 58 within the cylindrical outer wall 46 and beneath or below the inner wall 44 (i.e., within the exhaust fan chamber 52), and a plurality of hollow vanes 80 which reside within annular fluid passage chamber 48 and delimit partial passageway walls for each of the aligned or registered aperture pairs of the inner 44 and outer 46 walls. Each of the hollow vanes 80 are characterized by a leading edge 82 at least one trailing edge 84, e.g., two trailing edges 84 as shown and each delimiting a partially walled passageway 86 for radial fluid flow from exterior of the outer wall 44 to and through the inner wall 46 of the fan housing 42 and into the central drive chamber 50. Advantageously, but not necessarily, the contemplated hollow vanes are adapted so as to facilitate integration to/with the windband in furtherance of the support of same via the fan assembly, more particularly, the fan housing.

With general reference now to the assemblies or subassemblies of either of FIG. 3 or 4, there is shown select subassemblies or structures of an exhaust assembly. As a preliminary matter, it is to be noted that improved acoustic performance for the contemplated exhaust assembly, owing to selective insulation of subassemblies and/or structures thereof, utilizing a closed cell insulation as opposed to fiberglass, perf plate, baffles, etc., is generally realized. More particularly, windband 100 of windband assembly 16 (i.e., its air discharge, e.g., $Q_T$, contacting face or surface, FIG. 3A), and/or the outer wall 46 of the fan housing 42 (i.e., its air discharge, e.g., $Q_F$, contacting face or surface, FIG. 3A or 4A) are equipped with closed cell insulation 17, e.g., 2" thick closed cell foam.

Figure 3B:
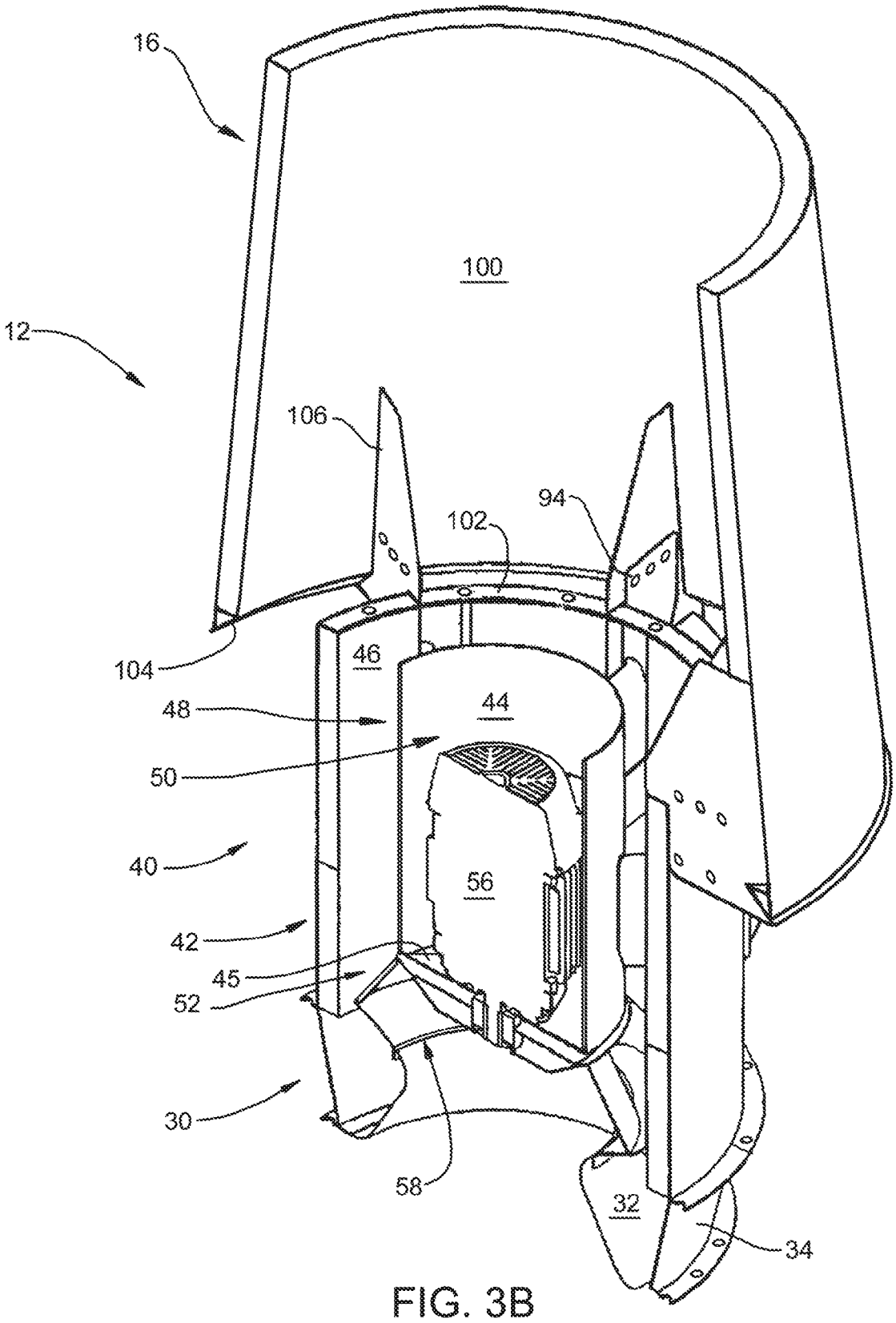
FIG. 3B is an alternate view of the section of FIG. 3A.
Figure 4B:
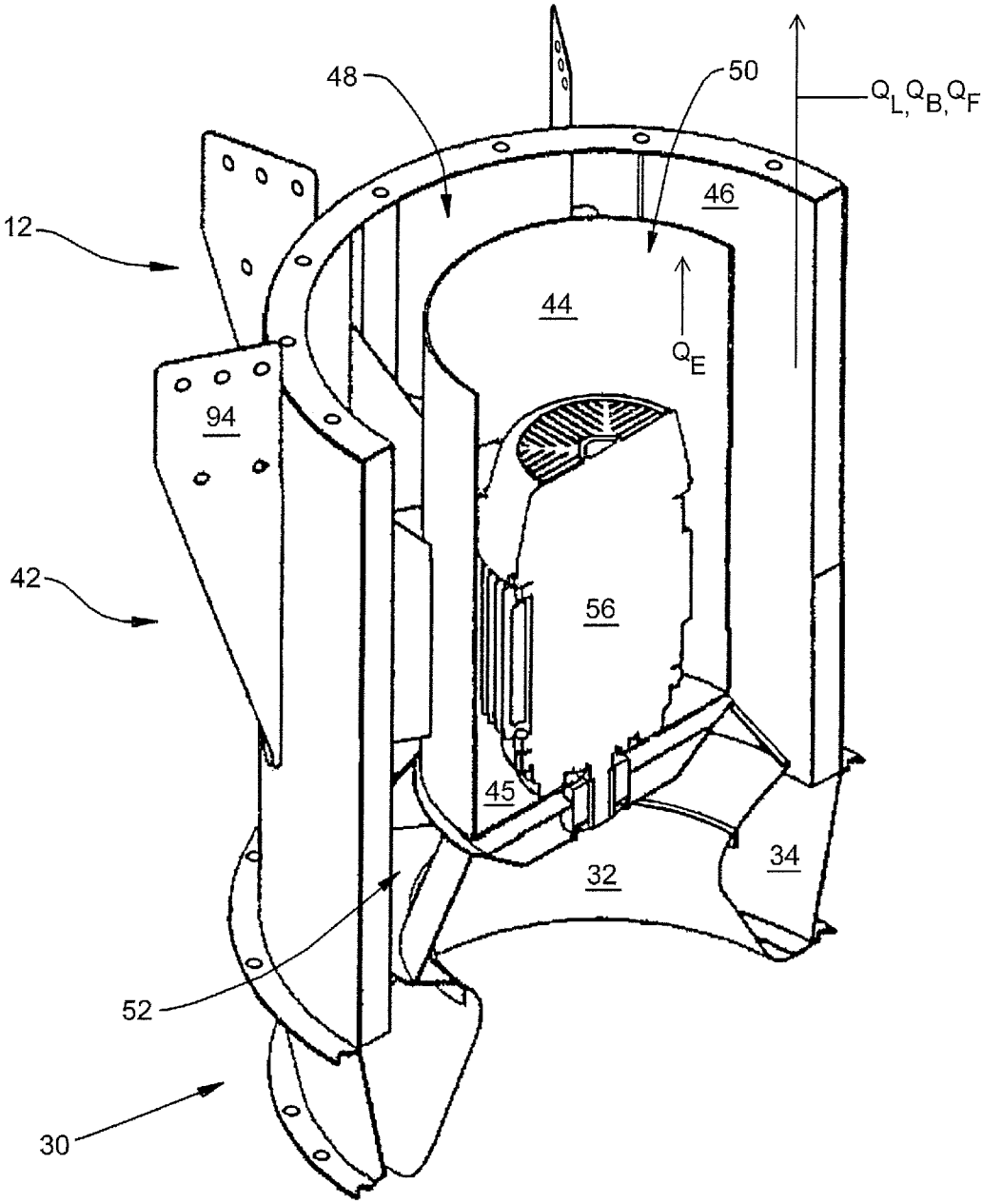
FIG. 4B is an alternate view of the section of FIG. 4A.

As previously noted, the fan assembly 12 is generally characterized by fan housing 42, and fan inlet cone housing or fan housing transition 34 mechanically united thereto, as by bolting about a flanged interface for the structures as depicted in either of FIG. 3B or 4B. The "fan" or impeller of the fan assembly generally comprises a fan wheel 58 having a wheel back 60 opposite a rim 62, and a plurality of spaced apart fan blades 64 uniting the wheel back 60 and the rim 62, and an inlet cone 32 depending from or adjacent the rim 62 of the fan wheel 58. As a direct drive fan is contemplated, fan motor 56 is operatively linked, via a shaft or other such coupling means, to fan wheel 58 in furtherance of imparting motion, i.e., rotation to the fan wheel.

Figure 6A:
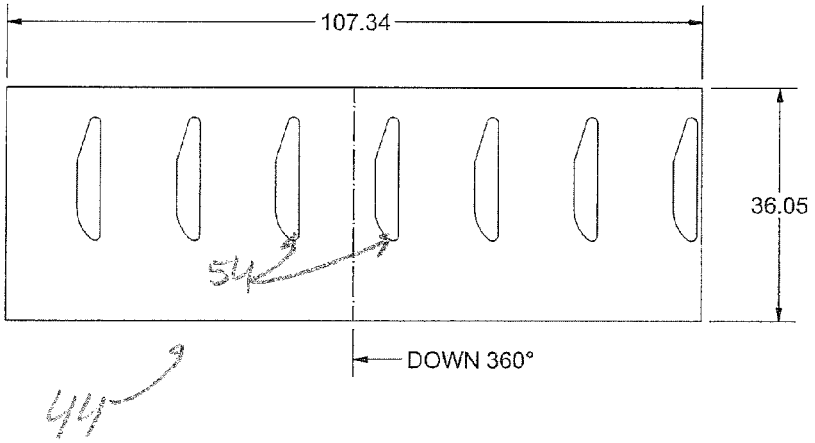
FIG. 6A depicts a flat pattern plan of the fan housing shell of FIG. 6.
Figure 7A:
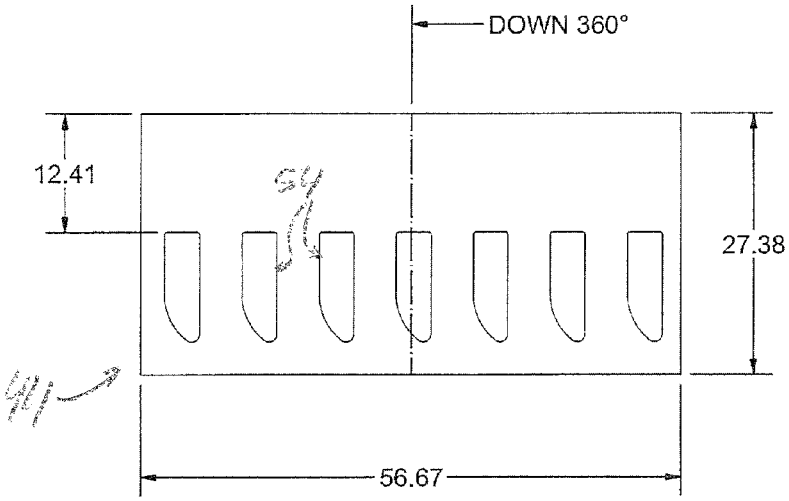
FIG. 7A depicts a flat pattern plan of the motor housing shell of FIG. 7.

The fan housing 42 of the fan assembly 12 is generally characterized by, among other features, cylindrical spaced apart first (e.g., outer 46) and second (e.g., inner 44) concentric walls, and annular space 48 delimited thereby. In as much as the outer wall may be fairly characterized as a cylinder having "open" opposed or opposing ends, i.e., a sleeve or sleeve like structure, the interior wall may be fairly characterized as cylinder have one "open" end opposite a "closed" end, namely, and as depicted, an open "top" and a closed "bottom." Passing initial reference is likewise made to FIGS. 6A & 7A which, while depicting advantageous, non-limiting flat pattern plans of/for the interior wall or motor housing shell, nonetheless notionally represent corresponding flat pattern plans of/for the outer wall.

In connection to the cylindrical inner wall 44, it generally defines central drive chamber 50 within which fan motor 56 resides. As indicated, the cylindrical or conical inner wall 44 includes a base 45 so as to thereby delimit a motor shell for support of the fan motor, which is adapted in furtherance of operative union of the fan motor to the fan wheel. Moreover, and as is best appreciated with reference to either of FIG. 6/6A or 7/7A, inner wall 44 (e.g., FIG. 6 or 7) includes spaced apart apertures 54, advantageously, but not exclusively, as laid out and configured as per FIGS. 6A & 7A. Via the contemplated arrangement/configuration of the inner wall or motor housing shell, the motor/central drive chamber is thereby isolated from vented space exhaust, more particularly, in the previously established vernacular, while entrained flow $Q_E$ passes into the motor housing shell, vented space exhaust $Q_L$, by-pass flow $Q_B$ and fan flow $Q_F$ do not pass into or through the motor housing shell.

In connection to the cylindrical outer wall 46, it, in combination with or in relation to the cylindrical or conical inner wall 44, delimits annular space 48 into and through which several flows are associated, as well as a volume, i.e., chamber 52, within which the fan wheel resides. As previously indicated, cylindrical outer wall 46, as cylindrical inner wall 44, includes spaced apart apertures 54 advantageously laid out and configured to mimic those of the inner wall 44 of the central drive chamber 50, and to be in opposition (i.e., registered or registering paired opposition) with regard to same so as to delimit passageways, i.e., entrained flow $Q_E$ component (see e.g., FIG. 1) passageways 86.

As is notionally depicted (see e.g., FIG. 4B), annular space or chamber 48 of fan housing 42 is advantageously and fairly characterized as "ring" of constant "width" throughout its "height." More particularly, and with reference to FIG. 4A, dimension "d" between the cylindrical inner and outer walls is preferably, but not necessarily, substantially constant.

Traversing the annular space of the fan housing are passageway walls which unite the cylindrical inner and outer walls, more particularly, which link paired spaced apart apertures or through holes of the inner and outer walls of the fan housing. Advantageously, but not necessarily, the passageway walls are partial walls, i.e., not continuous, and more particularly, the passageway walls are configured as airfoil-shaped hollow vanes, see e.g., FIG. 5 or 5A. Via the subject relation for, between and among the cylindrical or conical inner wall, cylindrical outer wall, and the passageway walls therebetween, each of the vented space flow $Q_L$, by-pass flow $Q_B$, and fan flow $Q_F$ pass through the annular space of the fan housing, with, as previously noted, an entrained flow $Q_E$ component passing through the passageways of the fan housing (see FIG. 4B).

Figure 5A:
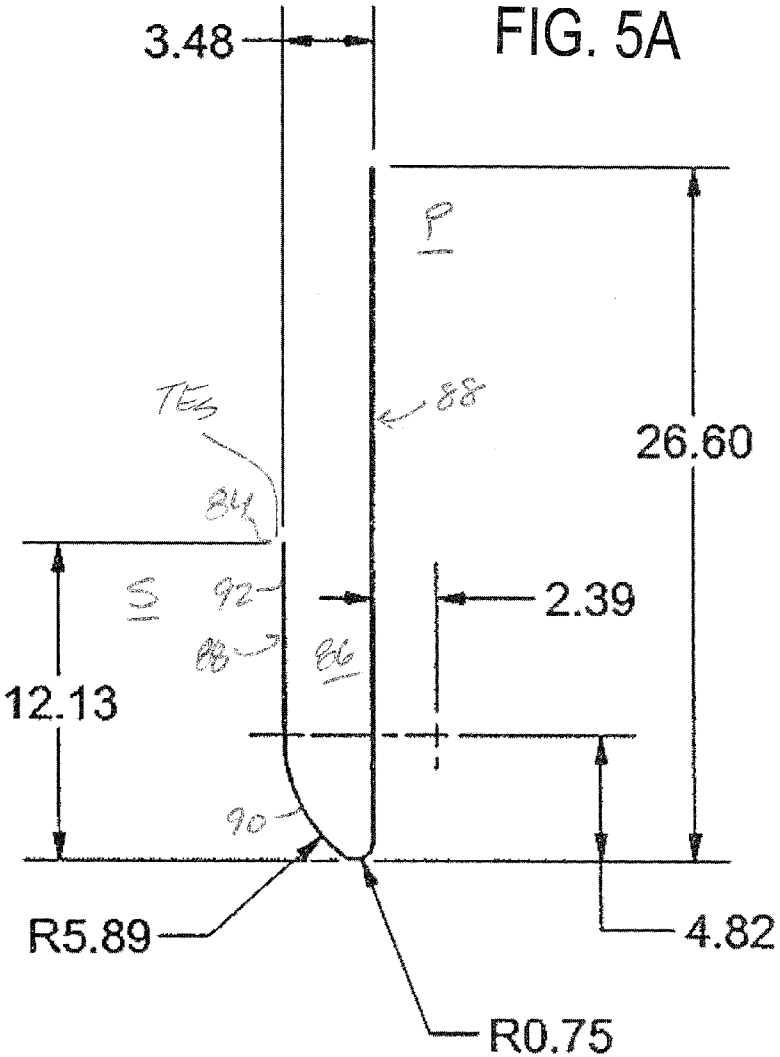
FIG. 5A is an end view of the vane of FIG. 5.
Figure 5:
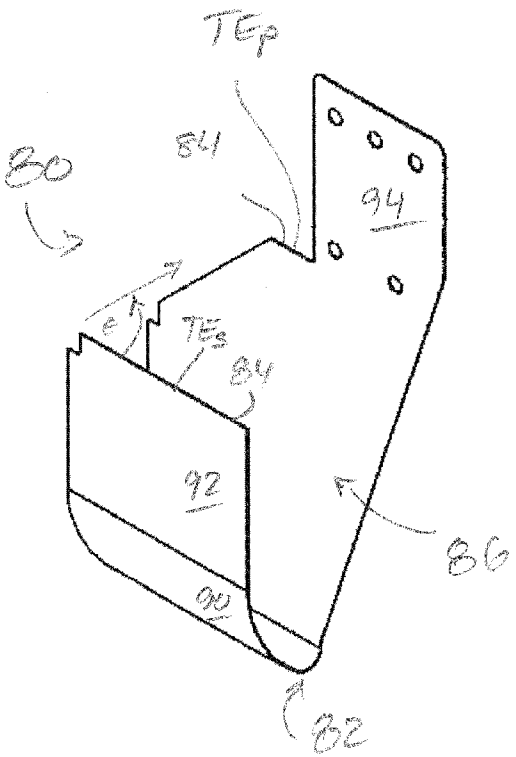
FIG. 5 depicts, in perspective, a representative, non-limiting hollow vane of the fan housing of FIG. 4.
Figure 5C:
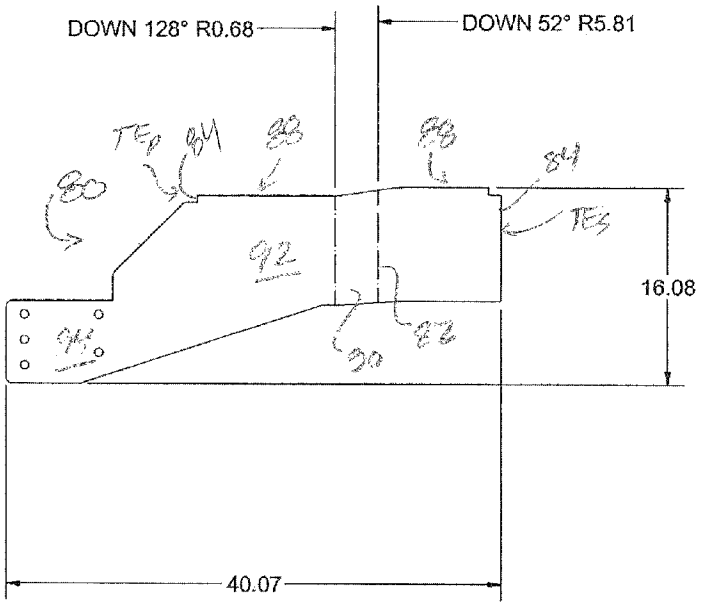
FIG. 5C depicts a flat pattern plan of the vane of FIG. 5.
Figure 5B:
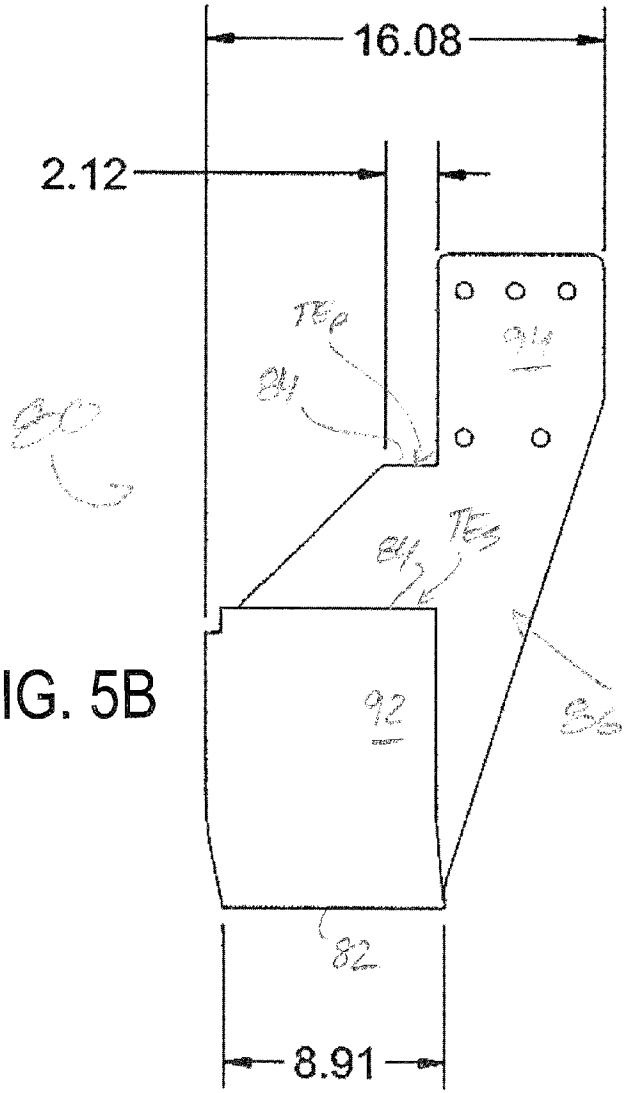
FIG. 5B is side view of the vane of FIG. 5.

With general reference now to the structure of FIG. 5 and associated views thereof in FIGS. 5A-5C, an advantageous, non-limiting passageway wall, e.g., hollow vane 80, is depicted. As preliminary matter, the structure of FIG. 5 is part and parcel of the fan housing of, for example. FIG. 3, and, not inconsistent with the passageways of FIG. 6. Moreover, a further, alternate, non-limiting passageway wall is noted in connection to the fan housing of, for example, FIG. 2, and not inconsistent with the passageways of FIG. 7.

Hollow vane 80 is generally characterized by leading edge 82, i.e., a "front," "lower" (as depicted) or down-stream structure, from which extends first and second spaced apart passageway wall segments 88 (see e.g., FIG. 5A). Each of the first and second spaced apart passageway wall segments 88 have free end portions which delimit trailing edges 84, i.e., "back," "upper" (as depicted) or up-stream structures, for hollow vane 80 which delimit partial walled passageway 86 (see e.g., FIG. 5).

In connection to the passageway wall structures, and as previously noted, each may be fairly characterized as an airfoil-shaped hollow vane. Attendant to such structures are generally known properties and relationships, see e.g., "Wing Geometry Definitions," NASA, Glenn Research Center, http://wright.nasa.gov/airplane/geom.html, incorporated herein, in its entirety, by reference.

With regard to each of the passageway walls or wall structures, leading edge 82 thereof generally delimits pressure (P) and suction (S) "sides" or surfaces of/for the structure as indicated, and, as an aid to further discussion, the trailing edge portions 84 of hollow vanes 80 are indicated as pressure ($TE_P$) and suction ($TE_S$) trailing edges. As is generally indicated, the pressure surface of the passageway wall structure is advantageously, but not necessarily, linear (i.e., the pressure surface linearly extends from the leading edge). Moreover, a first portion or segment 90 of the suction surface proximal to leading edge 82 generally diverges from the pressure surface, with a second portion or segment 92 of the suction surface advantageously, but not necessarily, being in a spaced apart parallel relationship with the pressure surface of the hollow vane/passageway wall structure.

As previously noted, the passageway wall structure may be fairly characterized as an airfoil or airfoil-like. In connection to vane geometry, more particularly, airfoil geometry, several definitions and structural features/relationship are to be noted, particulars to follow generalities.

Generally, as is well known (see "Wing Geometry Definitions"), the straight line drawn from the leading to trailing edges of the airfoil is called the chord line. The chord line cuts the airfoil into an upper surface and a lower surface. A plot of the points that lie halfway between the upper and lower surfaces yields a curve called the mean camber line. For a symmetric airfoil, the upper surface is a reflection of the lower surface and the mean camber line will overlay the chord line, however, more often than not, the mean camber line and the chord line are two separate lines, with the maximum distance between the two lines referred to as the camber (C), i.e., a measure of the curvature of the airfoil, with high camber representing a high curvature. The maximum distance between the upper and lower surfaces is called the thickness (TH).

Particularly, with reference to the contemplated airfoil or airfoil-like passageway wall structure, the distance from the leading to trailing edges is called the chord, with chord lengths generally depicted or referenced, maximum, for each of the pressure and suction surfaces of/for the passageway walls or wall structures (FIG. 5A), i.e., maximum chord lengths "LPS" (pressure) and "LSS" (suction). A leading edge radius is generally noted as "RLE," with leading and trailing edge skew angles ($SA_{LE}$ and $SA_{TE}$, respectively), FIG. 5B, being a departure from "horizontal" as measured from a plane that is normal to the axial direction and/or mean airflow direction, e.g., SA equals 0° for the depicted suction surface trailing edge of FIG. 5B. Moreover, vane chord (V) and chord ratio (CR) are generally defined as follows:

$$L=\max(LPS,LSS);\ CR=\min(LPS,LSS)/L$$

In light of the foregoing, the following parameter ranges are contemplated, and believed advantageous, though not necessarily limiting:

CR=10 to 100%
TH/L=1 to 50%
C/L=0 to 25%
RLE/L=0 to 25%
$SA_{LE}$=−50 to +50.
$SA_{TE}$=−80 to +80.

Moreover, with regard to the number of hollow vanes for a given application, while there exists a structural tension between the cylindrical outer and inner walls, i.e., the motor, and thus the motor shell or inner wall are structurally supported by the outer wall of the fan housing, it is believed that an advantageous, non-limiting relationship exists between the number of hollow vanes and the nature of the fan wheel/impeller. More particularly, the number of hollow vanes "n" may be generally correlated to/with the number of impeller blades "x" via the expression n=x+/−1, with n advantageously thereafter selected so as to be a prime number, namely, the next highest or lowest prime number "n."

In as much as the hollow vanes may be configured so as to have an asymmetrical leading edge (i.e., a lack of symmetry about a leading edge center line, or, in the aforementioned semantic, the mean camber line does not fall upon the chord line), the hollow vanes are likewise contemplated to be configured to have a symmetrical leading edge (i.e., the mean camber line falls upon the cord line). Such straight centerline hollow vane configuration is believed especially advantageous wherein flow reversibility is a consideration. For example, and without limitation, emergency tunnel ventilation utilizes reversible jet fans in furtherance of handling fire and chemical emergencies in underground tunnels. With a jet fan housing characterized by hollow vanes having oval or other symmetric configuration, greater fresh air introduction as an aid to extended motor operation is believed possible, with improved thrust realized.

Returning briefly to the representation of the partial passageway wall of FIG. 5 or 5B, as well as select contextual representations thereof as will be noted, it is advantageously contemplated to include/incorporate a flange or tab 94 in furtherance of supporting a windband 100 or windband assembly 16. Each of the hollow vanes 80 is generally adapted to include a flange or tab 94 which outwardly and upwardly extends from a wall segment of the spaced apart passageway wall segments delimiting the hollow vane (see, e.g., FIG. 4A), more particularly, as shown, the pressure surface of the hollow vane (see e.g., FIG. 4 or FIG. 5B).

Figure 8A:
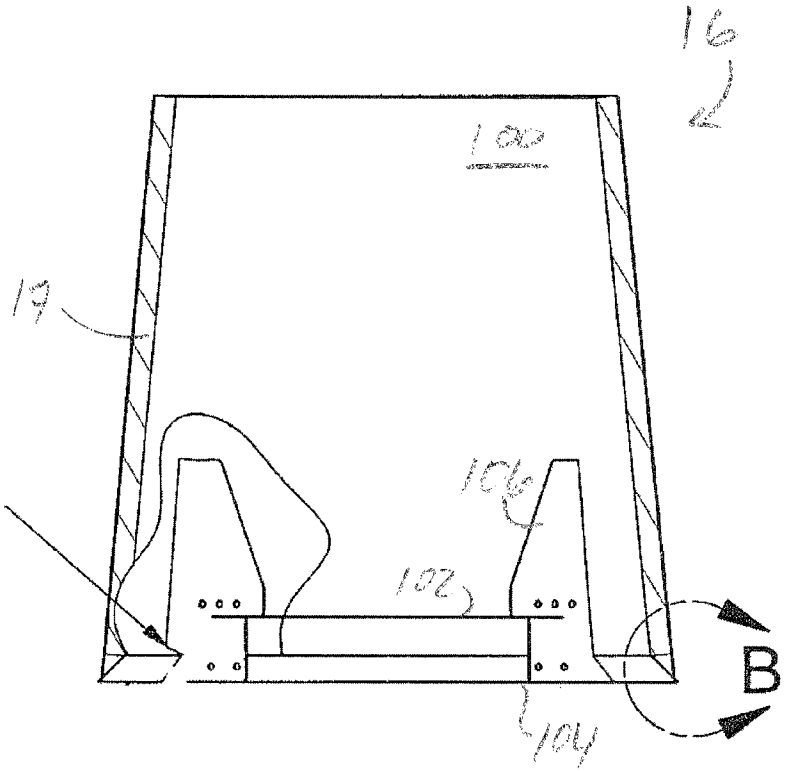
FIG. 8A is a section, about line A-A, of the insulated windband assembly of FIG. 8; and, FIG. 8B is an alternate view of the section of FIG. 8A.
Figure 8:
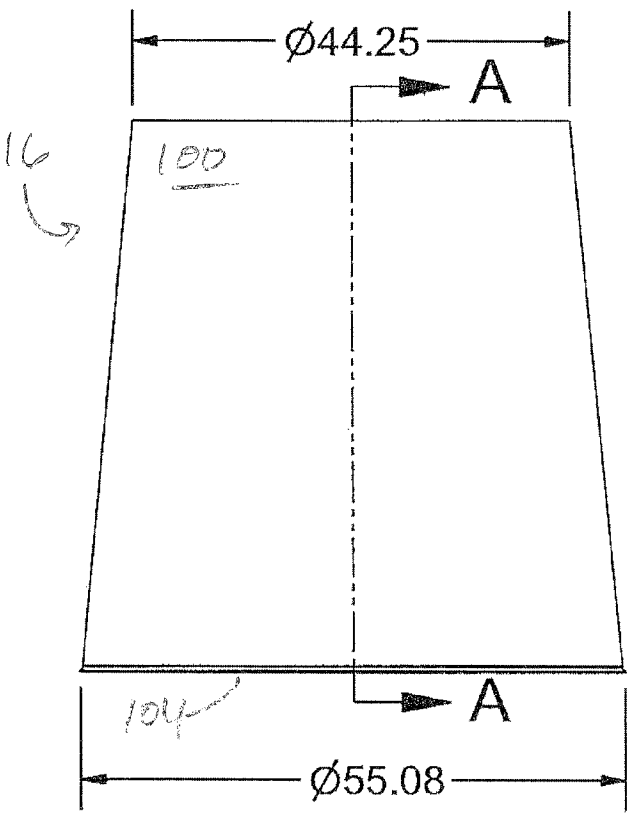
FIG. 8 depicts, in elevation, a representative, non-limiting insulated windband assembly of/for the sound attenuated fan assembly of FIG. 3.
Figure 8B:
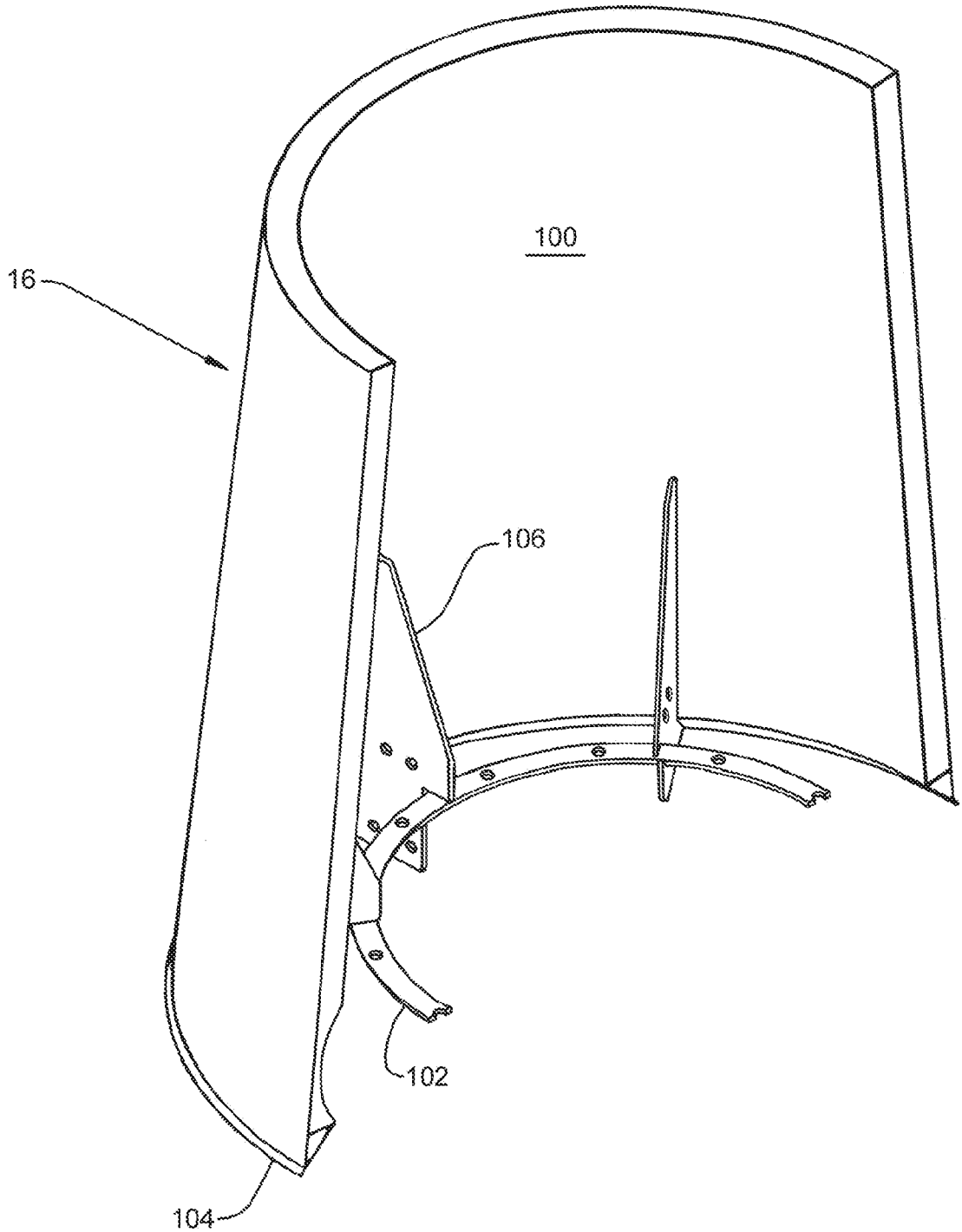

With reference now to FIG. 8 and the sectional views thereof, a preferred, non-limiting windband assembly 16 is noted. Again, as was previously noted with regard to the cylindrical outer wall of the fan housing, an interior surface or face of the windband 100 of the windband assembly 16 is adapted to include a closed cell foam insulation 17 in furtherance of improved acoustic performance of the exhaust fan housing/exhaust fan assembly. Moreover, as indicated, a windband flange 102 is held interior of a lower peripheral rim 104 of the windband 100, and spaced apart therefrom, via radially spaced apart brackets 106. As should be readily appreciated with reference to, e.g., FIG. 3B, the windband brackets 106 are operatively mated with the flanges or tabs 94 of the wall segment of the spaced apart passageway wall segments of hollow vanes 80 (see, e.g., FIG. 4A).

Thus, in light of the foregoing assemblies, subassemblies, and structures, heretofore known exhaust fan housing or housing related elements such as, among other things, single thickness vanes and contraction nozzles, are eliminated while nonetheless retaining the functions of those elements. Moreover, via the described and/or depicted assembly elements, their relationships and interrelationships, improved pressure versus flow characteristics are noted with reference to heretofore known exhaust assemblies. Further still, improved sound attenuation is likewise achieved via the described and/or depicted assembly elements, their relationships and interrelationships.

Finally, since the structures of the assemblies/mechanisms disclosed herein may be embodied in other specific forms without departing from the spirit or general characteristics thereof, some of which forms have been indicated, the embodiments described and depicted herein/with are to be considered in all respects illustrative and not restrictive. Accordingly, the scope of the one or more disclosed inventions is/are as defined in the language of the appended claims, and includes not insubstantial equivalents thereto.

That which is claimed:

1. An exhaust fan housing comprising
a first cylindrical or conical element,
a second cylindrical element interior of said first cylindrical or conical element, and
an annular chamber having an outer wall formed by the first cylindrical or conical element and an inner wall formed by the second cylindrical element,
a plurality of hollow vanes extending radially across the annular chamber and operatively uniting said first cylindrical or conical element and said second cylindrical element,
an interior space delimited by said second cylindrical element in fluid communication with ambient air exterior of said first cylindrical or conical element via said hollow vanes, each hollow vane characterized by spaced apart wall segments which unitingly terminate so as to extend radially from the outer wall to the inner wall of the annular fluid passage chamber delimiting an airfoil-shaped leading edge for each hollow vane, each of said spaced apart wall segments having an open end extending radially across the annular chamber delimiting first and second trailing edges for each hollow vane, one trailing edge of said spaced apart wall segments include a tab extending radially outward beyond an exterior of the first cylindrical or conical element for mated union with a portion of a windband assembly to operatively link the windband assembly to said exhaust fan housing.

2. The exhaust fan housing of claim 1 in operative combination with a fan.

3. The exhaust fan housing of claim 1 in operative combination with a fan housing.

4. The exhaust fan housing of claim 1 in operative combination with a wind band.

5. The exhaust fan housing of claim 1 in operative combination with a wind band assembly.

6. An exhaust fan housing comprising
a first cylindrical or conical element,
a second cylindrical element interior of said first cylindrical or conical element, and
an annular chamber having an outer wall formed by the first cylindrical or conical element and an inner wall formed by the second cylindrical element, a plurality of hollow vanes extending radially across the annular chamber and operatively uniting said first cylindrical or conical element and said second cylindrical element, an interior space delimited by said second cylindrical element in fluid communication with ambient air exterior of said first cylindrical or conical element via said hollow vanes, each hollow vane characterized by spaced apart wall segments which unitingly terminate so as to extend radially from the outer wall to the inner wall of the annular fluid passage chamber delimiting an airfoil-shaped leading edge for each hollow vane, each of said spaced apart wall segments having an open end extending radially across the annular chamber delimiting first and second trailing edges for each hollow vane, one trailing edge of said spaced apart wall segments include an upwardly extending tab extending radially outward beyond an exterior of the first cylindrical or conical element for mated union with a portion of a windband assembly to operatively link the windband assembly to said exhaust fan housing.

7. The exhaust fan housing of claim 6 in operative combination with a fan.

8. The exhaust fan housing of claim 6 in operative combination with a fan housing.

9. The exhaust fan housing of claim 6 in operative combination with a wind band.

10. The exhaust fan housing of claim 6 in operative combination with a wind band assembly.

11. An exhaust fan assembly comprising:

a. a plenum for receipt of exhaust and bypass flow;

b. a fan assembly in fluid communication with said plenum and characterized by first and second fan assembly portions, said first portion comprising a fan inlet cone in combination with an inlet cone housing, said second portion comprising a fan housing characterized by spaced apart inner and outer walls, which delimit i) an annular fluid passage chamber between said inner wall and said outer wall, ii) a central drive chamber circumferentially bounded by said inner wall and adapted to retain a motor for an exhaust fan, and iii) an exhaust fan chamber within said outer wall and below said inner wall, and a plurality of hollow vanes extending between said inner wall and said outer wall of said fan housing of said second fan assembly portion so as to reside within said annular fluid passage chamber thereof, each hollow vane characterized by an airfoil-shaped leading edge extending radially from the outer wall to the inner wall of the annular fluid passage chamber and two trailing edges, each of said inner and outer walls adapted such that said each hollow vane delimits a partially walled passageway having an open end extending radially across the annular fluid passage chamber for radial fluid flow from exterior of said outer wall through said inner wall and into said central drive chamber; and, c. a windband assembly operatively linked to said fan assembly, said windband assembly characterized by a plurality of brackets for mated securement to a portion of each hollow vane that extends exterior of said outer wall to operatively link said windband assembly to said fan housing.

12. An, exhaust fan assembly of claim 11 wherein an inner surface of a windband of said windband assembly is equipped with closed cell foam in furtherance of sound attenuation.

13. An exhaust fan assembly of claim 11 wherein said annular fluid passage chamber between said inner wall and said outer wall is characterized by sound attenuation material.

14. An exhaust fan assembly of claim 11 wherein an inner surface of said outer wall is equipped with closed cell foam in furtherance of sound attenuation.

15. An exhaust fan assembly of claim 14 wherein an inner surface of a windband of said windband assembly is equipped with closed cell foam in furtherance of sound attenuation.

16. The exhaust fan assembly of claim 11 wherein each hollow vane further comprises a first passageway wall segment of a delimited partially walled passageway characterized by a first chord length, and a second wall passageway wall segment of said delimited partially walled passageway characterized by a second chord length, said first chord length being greater than said second chord length.

17. The exhaust fan assembly of claim 11 wherein each hollow vane further comprises a first passageway wall segment of a delimited partially walled passageway characterized by a first chord length, and a second wall passageway wall segment of said delimited partially walled passageway characterized by a second chord length, said first chord length being substantially equivalent to said second chord length.

18. The exhaust fan assembly of claim 11 wherein each hollow vane further comprises a first passageway wall segment of a delimited partially walled passageway defining a pressure surface characterized by a first chord length, and a second wall passageway wall segment of said delimited partially walled passageway defining a suction surface characterized by a second chord length, said first chord length being greater than said second chord length.

19. The exhaust fan assembly of claim 11 wherein each hollow vane further comprises a first passageway wall segment of a delimited partially walled passageway defining a pressure surface characterized by a first chord length, and a second wall passageway wall segment of said delimited partially walled passageway defining a suction surface characterized by a second chord length, said first chord length being substantially equivalent to said second chord length.

20. The exhaust fan assembly of claim 11 wherein each trailing edge of said two trailing edges is characterized by a skew angle of about zero degrees.

21. The exhaust fan assembly of claim 11 wherein each trailing edge of said two trailing edges of each of said spaced apart passageway wall segments is characterized by a skew angle within a range of about −80 to +80 degrees.

22. The exhaust fan assembly of claim 11 wherein said leading edge of each hollow vane of said hollow vanes is characterized by a skew angle of about zero degrees.

23. The exhaust fan assembly of claim 11 wherein said leading edge of each hollow vane of said hollow vanes is characterized by a skew angle within a range of about −50 to +50 degrees.

24. The exhaust fan assembly of claim 11 wherein said leading edge of each hollow vane of said hollow vanes is characterized by a leading edge radius to maximum chord length ratio having a value within a range of about 0-0.25.

25. The exhaust fan assembly of claim 11 wherein each passageway wall of a delimited partially walled passageway is characterized by a chord ratio having a value within a range of about 0.1-1.0.

26. The exhaust fan assembly of claim 11 wherein each passageway wall of a delimited partially walled passageway is characterized by a thickness to minimum chord ratio having a value within a range of about 0.01-0.5.

27. The exhaust fan assembly of claim 11 wherein each passageway wall of a delimited partially walled passageway is characterized by a camber to minimum chord ratio having a value within a range of about 0-0.25.

28. The exhaust fan assembly of claim 11 wherein a passageway wall of a delimited partially walled passageway is adapted to include a tab for mated union with a portion of a windband assembly to operatively link said windband to said fan housing.

29. The exhaust fan assembly of claim 11 wherein a passageway wall of a delimited partially walled passageway is adapted to include an upwardly extending tab for mated union with a portion of a windband assembly to operatively link said windband to said fan housing.

30. The exhaust fan assembly of claim 11 further comprising closed cell insulation, an interior surface of said outer wall adapted to include said closed cell insulation.

31. The exhaust fan assembly of claim 11 wherein a spacing for and between said inner and outer walls is substantially constant along a shared axial centerline for each of said inner and outer walls.

32. The exhaust fan assembly of claim 11 wherein said leading edge of each hollow vane of said hollow vanes is symmetrical about a centerline thereof.

33. The exhaust fan assembly of claim 32 further comprising closed cell insulation, an interior surface of said first outer wall adapted to include said closed cell insulation.

34. The exhaust fan assembly of claim 11 wherein said leading edge of each hollow vane of said hollow vanes is asymmetric about a centerline thereof.

35. The exhaust fan assembly of claim 34 further comprising closed cell insulation, an interior surface of said first outer wall adapted to include said closed cell insulation.

* * * * *